US009051809B2

(12) United States Patent
Morrison

(10) Patent No.: US 9,051,809 B2
(45) Date of Patent: Jun. 9, 2015

(54) CASING RELIEF VALVE

(75) Inventor: Jeffery Morrison, Missouri City, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 383 days.

(21) Appl. No.: 13/458,673

(22) Filed: Apr. 27, 2012

(65) Prior Publication Data

US 2012/0273227 A1 Nov. 1, 2012

Related U.S. Application Data

(60) Provisional application No. 61/481,102, filed on Apr. 29, 2011.

(51) Int. Cl.

| | |
|---|---|
| ***E21B 34/06*** | (2006.01) |
| ***E21B 34/10*** | (2006.01) |
| *E21B 34/00* | (2006.01) |

(52) U.S. Cl.

CPC ..... *E21B 34/06* (2013.01); *E21B 34/102* (2013.01); *E21B 2034/005* (2013.01)

(58) Field of Classification Search

USPC ..... 166/373, 374, 321, 323, 326; 137/512.15, 624.27

See application file for complete search history.

(56) References Cited

U.S. PATENT DOCUMENTS

| | | | |
|---|---|---|---|
| 1,793,193 | A | 2/1931 | Price |
| 2,251,977 | A | 8/1941 | Burt |
| 2,509,839 | A | 5/1950 | Panner |
| 3,193,016 | A | 7/1965 | Knox |
| 3,223,109 | A | 12/1965 | Cummings |
| 3,282,289 | A | 11/1966 | Vick |
| 3,292,706 | A | 12/1966 | Grimmer et al. |
| 3,294,108 | A | 12/1966 | Thrash |
| 3,583,481 | A | 6/1971 | Vernotzy |
| 3,606,926 | A | 9/1971 | Schwegman |
| 3,633,671 | A | 1/1972 | Nelson |
| 3,640,501 | A | 2/1972 | Walton |

(Continued)

FOREIGN PATENT DOCUMENTS

| | | |
|---|---|---|
| GB | 2290319 | 12/1995 |
| WO | 2010089728 | 8/2010 |

OTHER PUBLICATIONS

PCT International Search Report and Written Opinion dated Sep. 5, 2013, International Application No. PCT/US2012/035604.

(Continued)

*Primary Examiner* — Cathleen Hutchins

(74) *Attorney, Agent, or Firm* — Patterson & Sheridan, LLP

(57) ABSTRACT

A pressure relief valve assembly may be coupled to one or more casings and/or tubular members to control fluid communication therebetween. The valve assembly is a one-way valve assembly that relieves pressure within an annulus formed between adjacent casings and/or tubular members to prevent burst or collapse of the casings and/or tubular members. The valve assembly includes a tubular body having a port for fluid communication and a valve ring disposed within the tubular body, the valve ring having a flap for closing the port, wherein the flap is configured to flex from a closed position to an open position in response to a pressure differential. In another embodiment, the valve assembly also includes a retainer sleeve movable from an engaged position for maintaining the flap in a closed position to a disengaged position to allow the flap to open.

24 Claims, 5 Drawing Sheets

(56) References Cited

U.S. PATENT DOCUMENTS

| | | | | |
|---|---|---|---|---|
| 3,789,926 | A | 2/1974 | Henley et al. | |
| 3,807,444 | A * | 4/1974 | Fortune | 137/512.1 |
| 4,201,364 | A | 5/1980 | Taylor | |
| 4,602,684 | A | 7/1986 | Van Wormer et al. | |
| 5,263,683 | A | 11/1993 | Wong | |
| 5,271,428 | A | 12/1993 | Dunn et al. | |
| 5,316,084 | A | 5/1994 | Murray et al. | |
| 5,372,193 | A | 12/1994 | French | |
| 5,411,095 | A | 5/1995 | Ehlinger et al. | |
| 6,059,038 | A | 5/2000 | Vick, Jr. | |
| 6,230,811 | B1 | 5/2001 | Ringgenberg et al. | |
| 6,296,061 | B1 | 10/2001 | Leismer | |
| 6,457,528 | B1 | 10/2002 | Staudt | |
| 6,725,937 | B1 | 4/2004 | McHardy | |
| 6,899,126 | B2 * | 5/2005 | Weigand et al. | 137/512.15 |
| 7,191,830 | B2 | 3/2007 | McVay et al. | |
| 7,467,664 | B2 | 12/2008 | Cochran et al. | |
| 7,669,661 | B2 | 3/2010 | Johnson | |
| 8,276,618 | B2 * | 10/2012 | Cewers | 138/37 |
| 8,544,554 | B2 | 10/2013 | Schultz et al. | |
| 8,752,631 | B2 | 6/2014 | Stewart | |
| 2003/0070713 | A1 | 4/2003 | Cornea et al. | |
| 2004/0045605 | A1 * | 3/2004 | Floh et al. | 137/512.15 |
| 2006/0037645 | A1 | 2/2006 | Boldt et al. | |
| 2008/0000633 | A1 | 1/2008 | Xu et al. | |
| 2008/0121397 | A1 | 5/2008 | Galloway et al. | |
| 2008/0149200 | A1 | 6/2008 | Burkhard et al. | |
| 2009/0025930 | A1 | 1/2009 | Iblings et al. | |
| 2009/0056948 | A1 | 3/2009 | Martin et al. | |
| 2009/0133869 | A1 | 5/2009 | Clem | |
| 2011/0000679 | A1 | 1/2011 | Joseph et al. | |
| 2011/0278016 | A1 | 11/2011 | Xu | |
| 2013/0068532 | A1 | 3/2013 | Bansal et al. | |

OTHER PUBLICATIONS

Canadian Office Action for Patent Application No. 2,834,227 dated Sep. 23, 2014.

PCT Search Report and Written Opinion for International Application No. PCT/US2012/035589 dated Aug. 28, 2013.

PCT Search Report and Written Opinion for International Application No. PCT/US2012/035606 dated Aug. 16, 2013.

Canadian Office Action dated Dec. 17, 2014, Canadian Patent Application No. 2,834,293.

* cited by examiner

CASING RELIEF VALVE

CROSS-REFERENCE TO RELATED APPLICATIONS

This application claims benefit of U.S. Provisional Patent Application Ser. No. 61/481,102, filed on Apr. 29, 2011, which patent application is incorporated herein by reference in its entirety.

BACKGROUND OF THE INVENTION

1. Field of the Invention

Embodiments of the invention generally relate to a pressure relief valve assembly for a casing.

2. Description of the Related Art

Traditional well construction, such as the drilling of an oil or gas well, includes a wellbore or borehole being drilled through a series of formations. Each formation, through which the well passes, must be sealed so as to avoid an undesirable passage of formation fluids, gases or materials out of the formation and into the borehole. Conventional well architecture includes cementing casings in the borehole to isolate or seal each formation. The casings prevent the collapse of the borehole wall and prevent the undesired inflow of fluids from the formation into the borehole.

In standard practice, each succeeding casing placed in the wellbore has an outside diameter significantly reduced in size when compared to the casing previously installed. The borehole is drilled in intervals whereby a casing, which is to be installed in a lower borehole interval, is lowered through a previously installed casing of an upper borehole interval and then cemented in the borehole. The purpose of the cement around the casing is to fix the casing in the well and to seal the borehole around the casing in order to prevent vertical flow of fluid alongside the casing towards other formation layers or even to the earth's surface.

If the cement seal is breached, due to high pressure in the formations and/or poor bonding in the cement for example, fluids (liquid or gas) may begin to migrate up the borehole. The fluids may flow into the annuli between previously installed casings and cause undesirable pressure differentials across the casings. The fluid gas may also flow into the annuli between the casings and other drilling or production tubular members that are disposed in the borehole. Some of the casings and other tubulars, such as the larger diameter casings, may not be rated to handle the unexpected pressure increases, which can result in the collapse or burst of a casing or tubular.

Therefore, there is a need for apparatus and methods to prevent wellbore casing or tubular failure due to unexpected downhole pressure changes.

SUMMARY OF THE INVENTION

In one embodiment, a valve assembly includes a tubular body having a port for fluid communication and a valve ring disposed within the tubular body, the valve ring having a closure member for closing the port, wherein the closure member is configured to flex from a closed position to an open position in response to a predetermined pressure differential. In another embodiment, the valve assembly also includes a retainer sleeve movable from an engaged position for maintaining the closure member in a closed position to a disengaged position to allow the closure member to open. In yet another embodiment, the valve assembly further includes a biasing member for biasing the retainer sleeve in the engaged position. In yet another embodiment, the closure member is a flap.

In another embodiment, the closure member may be configured to open in response to a first predetermined pressure differential. The closure member may flex back to the closed position when the pressure differential has decreased to below a second predetermined value, wherein the first predetermined value is greater than or equal to the second predetermined value.

In another embodiment, a tubular assembly for lining a wellbore includes a tubular for lining a portion of the wellbore; and a valve assembly for controlling fluid flow between an exterior of the tubular and an interior of the tubular, wherein the valve assembly includes a body coupled to the tubular and having a port for fluid communication; and a valve ring disposed within the body, the valve ring having a closure member for closing the port, wherein the closure member is configured to flex from a closed position to an open position in response to a pressure differential.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In one embodiment, a pressure relief valve assembly may be coupled to one or more casings and/or tubular members to control fluid communication therebetween. The valve assembly is a one-way valve assembly that relieves pressure within an annulus formed between adjacent casings and/or tubular members to prevent burst or collapse of the casings and/or tubular members. The valve assembly may be resettable downhole.

Figure 1:
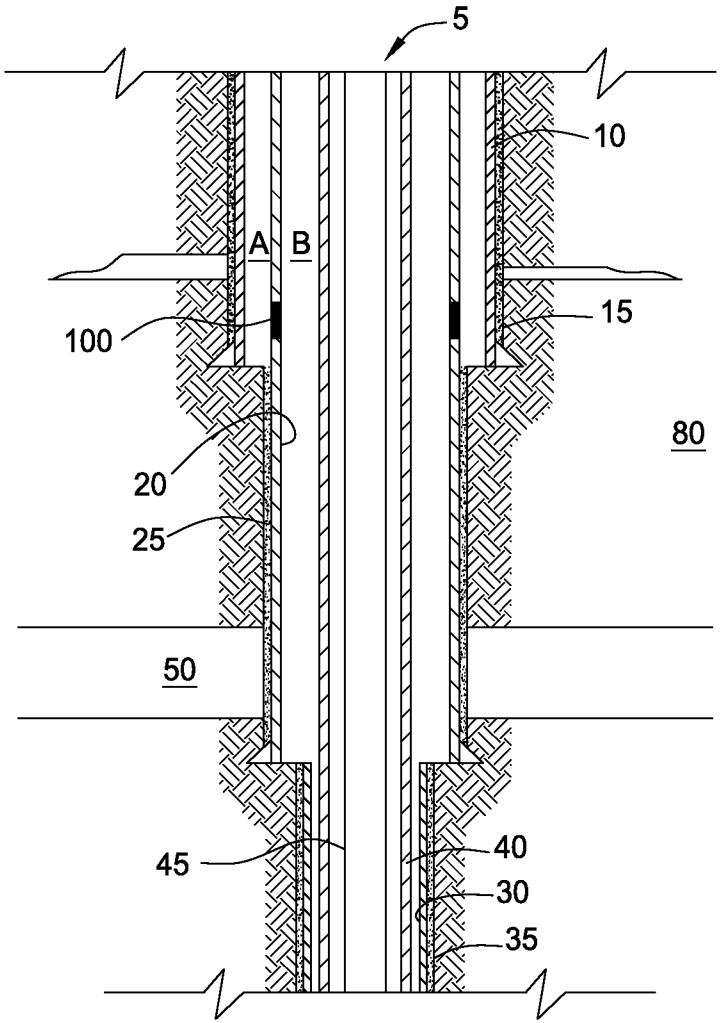
FIG. 1 is a schematic view of a wellbore.

FIG. 1 illustrates a wellbore 5 formed within an earthen formation 80. The walls of the wellbore 5 are reinforced with a plurality of casings 10, 20, 30 of varying diameters that are structurally supported within the formation 80. The casings 10, 20, 30 are fixed within the formation 80 using a sealing material 15, 25, 35, such as cement, which prevents the migration of fluids from the formation 80 into the annuli between the casings 10, 20, 30. One or more tubular members 40, 45, such as drilling or production tubular members, may also be disposed in the wellbore 5 for conducting wellbore operations. An annulus "A" is formed between the casing 10 and the casing 20, and an annulus "B" is formed between the casing 20 and the tubular member 40, which may also be a casing. It is important to note that the embodiments described herein may be used with other wellbore arrangements and are not limited to use with the wellbore configuration illustrated in FIG. 1.

The wellbore 5 may intersect a high pressure zone 50 within the formation 80. Fluids within the high pressure zone 50 are sealed from the annulus A and B by the sealing material 25 that is disposed between the casing 20 and the wellbore 5 wall. In the event that the sealing material 25 is breached or otherwise compromised, pressurized fluids may migrate upward into the annulus A and cause an unexpected pressure increase. The pressure rise may form a pressure differential across the casings 10, 20 that (if unchecked) may result in leakage through or burst of casing 10, and/or leakage through or collapse of casing 20. One or more valve assemblies 100, 200, 300 are provided to relieve the pressure in the annulus A prior to failure of one or both of the casings 10, 20.

FIGS. 2-5 illustrate an exemplary embodiment of a valve assembly 100 for relieving pressure in annulus A to prevent failure of the casings 10, 20. The valve assembly 100 may be coupled to the casing 20 in FIG. 1, but each of the casings 10, 20, 30 and/or the tubular members 40, 45 may similarly include one or more of the valve assembly 100 as described herein. The valve assembly 100 may be coupled to the casings 10, 20, 30 and/or the tubular members 40, 45 using a thread connection, a welded connection, and/or other similar connection arrangements.

Figure 2A:
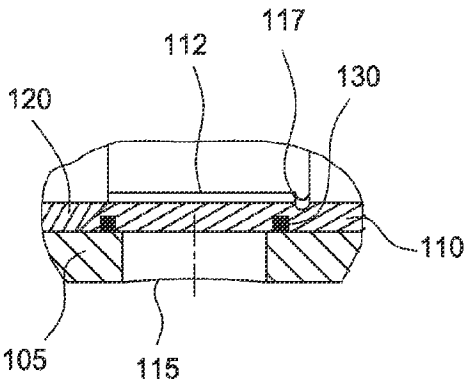
FIG. 2A is an enlarged, partial cross-sectional view of the valve assembly of FIG. 2.
Figure 2B:
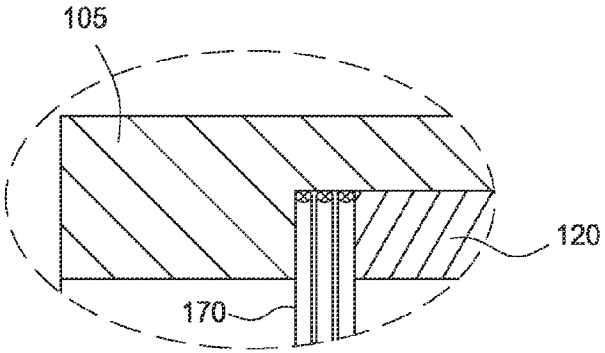
FIG. 2B is an enlarged, partial cross-sectional view of the valve assembly of FIG. 2.
Figure 2:
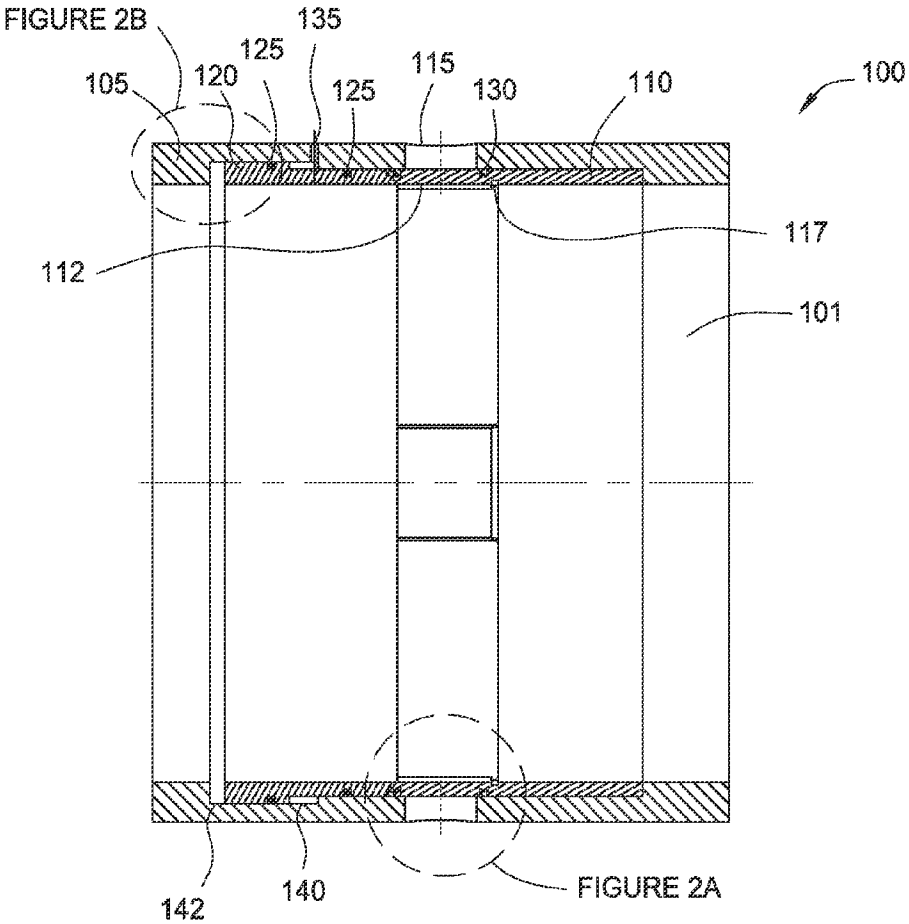
FIG. 2 is a partial cross sectional view of a valve assembly in a closed position.
Figure 4:
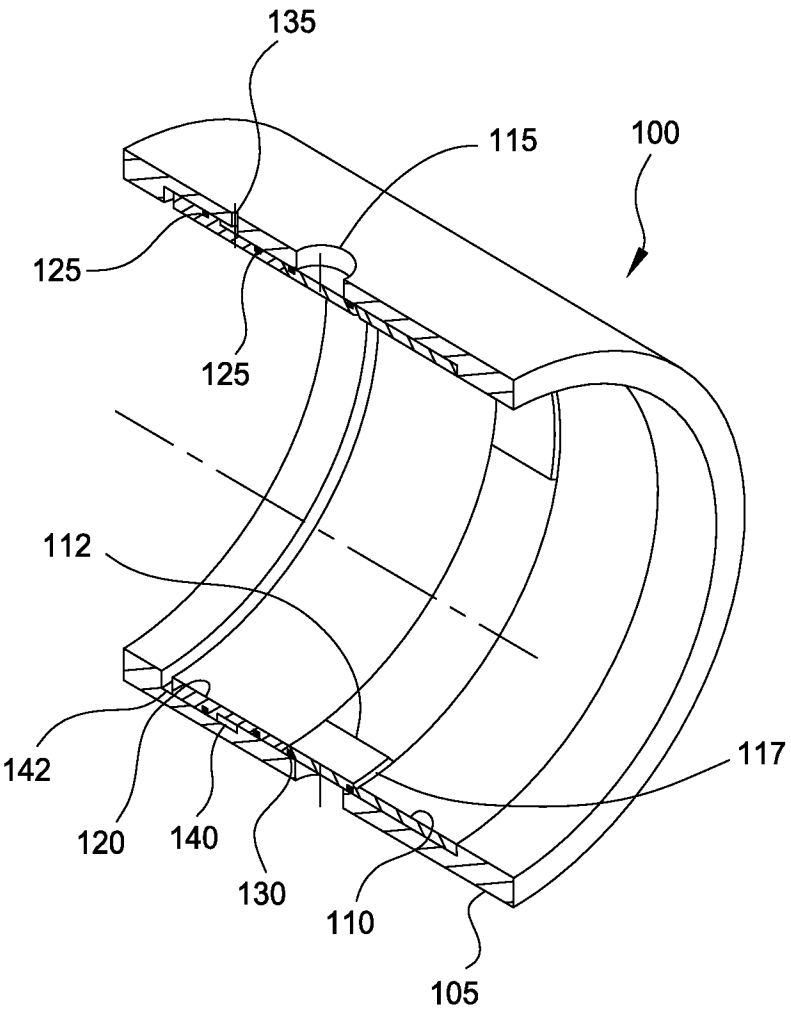
FIG. 4 is another partial cross-sectional view of the valve assembly of FIG. 2.

FIGS. 2, 2A, and 4 are partial cross-sectional views of the valve assembly 100 in a closed position. The valve assembly 100 includes a tubular body 105 connectable to casing 20 to form a part of the casing string. The body 105 has an axial bore 101 and one or more relief ports 115 formed through the wall of the body 105 for fluid communication between an exterior of the casing 20 and an interior of the casing 20. As shown in FIGS. 2 and 4, the body 105 includes four relief ports 115 circumferentially spaced around the body 105. In another embodiment, the body 105 may include any suitable number of relief ports, for example, two, three, five, or more ports. Additionally, the body 105 may include multiple ports disposed at different locations along the central axis of the body 105. Ports disposed at different axial locations on the body 105 may reduce the effect the ports have on the integrity, e.g., tensile strength, of the valve body 105.

Figure 6:
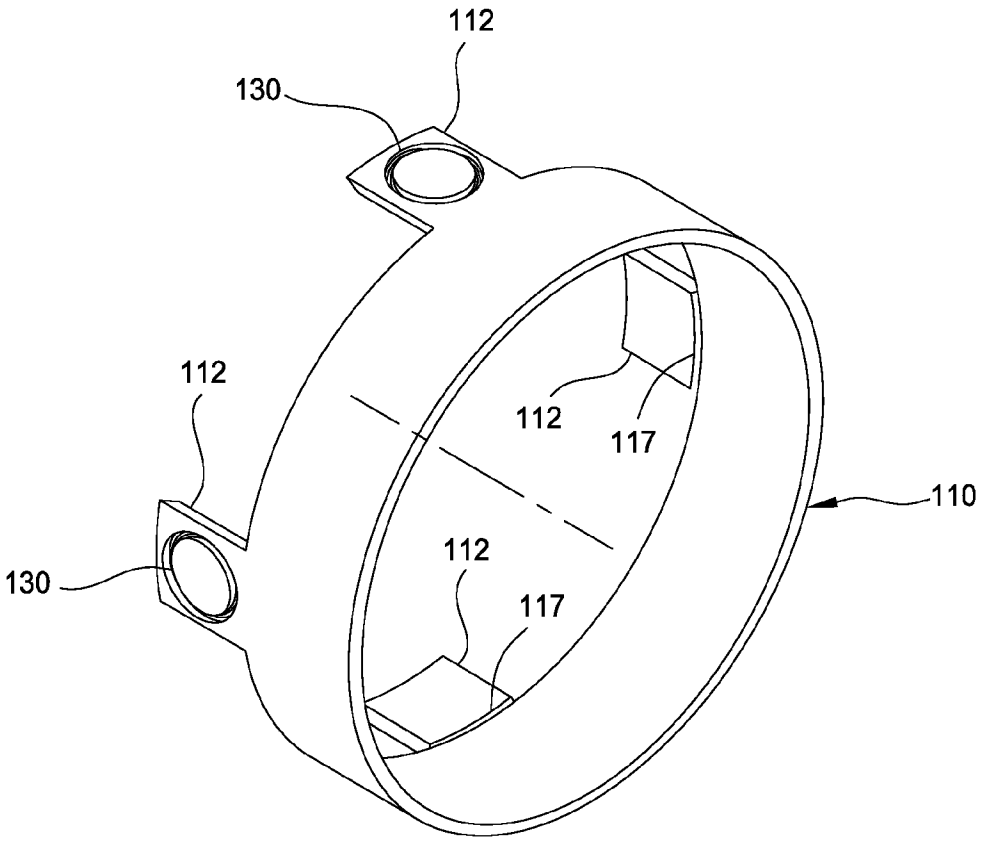
FIG. 6 is a perspective view of the valve ring of the valve assembly of FIG. 2.

A valve ring 110 is disposed on the interior wall of the body 105. As shown in FIGS. 2 and 4, the valve ring 110 is optionally disposed in a recess of the interior wall, thereby increasing the inner diameter clearance of the valve assembly 100. The valve ring 110 may be attached to the body 105 using a fastener, screw, spline connection, or other suitable connectors to prevent relative rotation therebetween. The valve ring 110 includes one or more closure members for operating the relief ports 115. An exemplary closure member is a flap 112 extending from the valve ring 110. The flaps 112 are more clearly seen in FIG. 6, which is a perspective view of the valve ring 110. Each flap 112 is positioned to cover a respective relief port 115 of the body 105. The relief port 115 is closed from fluid communication when covered by the flap 112. As shown, the valve ring 110 includes four flaps 112 to cover each of the four relief ports 115 of the valve ring 110. It must be noted the flaps 112 may be arranged based on the position of the relief ports 115. For example, one or more flaps 112 may extend from each end of the valve ring 110 to cover ports 115 that are positioned at different axial locations of the body 105. In particular, two flaps 112 may be positioned on one end and two flaps 112 may be positioned at the other end of the valve ring 110. In another example, the flaps 112 may be positioned between the ends of the valve ring 110. For example, the flaps 112 may be formed by cutting a desired shape of the flap 112 in the interior wall such that the flap 112 may flex relative to the interior wall. In the Figures, portions of the valve ring 110 between the flaps 112 have been cut out. However, removal of these portions is optional so long as the flaps 112 are able to flex in response to a pressure force. In this respect, the flaps may be formed as a cut out of the valve ring. Alternatively, the flaps may be attached to the valve ring.

In another embodiment, a seal 130 such as an o-ring may be affixed to the flap 112 to facilitate closure of the port 115. The seal 130 may encircle the port 115 when the flap 112 is covering the port 115. In yet another embodiment, the seal 130 may be positioned on the interior wall of the body 105 for sealing contact with the flap 112.

The flaps 112 are configured to flex inwardly to an open position to at least partially expose the relief ports 115 for fluid communication. In one embodiment, the flaps 112 may include an optional groove 117 to control the ability of the flaps 112 to flex. The degree and/or ease of the flaps 112 to flex may also be controlled by selecting the material from which the valve ring 110 is manufactured; selecting the dimensions such as width, length, and thickness; and combinations thereof. In one embodiment, the flaps 112 of the valve assembly 100 may be configured to open at same or different predetermined pressures.

In another embodiment, an optional retainer sleeve 120 may be used to prevent premature opening of the flaps 112. The retainer sleeve 120 may include an inwardly taper edge 121 at one end for engaging an outwardly taper edge 122 of the flap 112, which can be seen in FIG. 3A. When the taper edges 121, 122 are engaged, the flap 112 is prevented from opening. Pressure inside the bore 101 of the valve assembly 100 keeps the retainer sleeve 120 engaged with the flaps 112. An optional biasing member 170 such as a spring may be used to provide an additional force for maintaining the retainer sleeve in the engaged position, as shown in FIG. 2B. In one embodiment, the inner diameter of the body 105, valve ring 110, flap 112, and the retainer sleeve 120 is equal to or greater than the inner diameter of the casing to which the valve assembly is attached.

Figure 3:
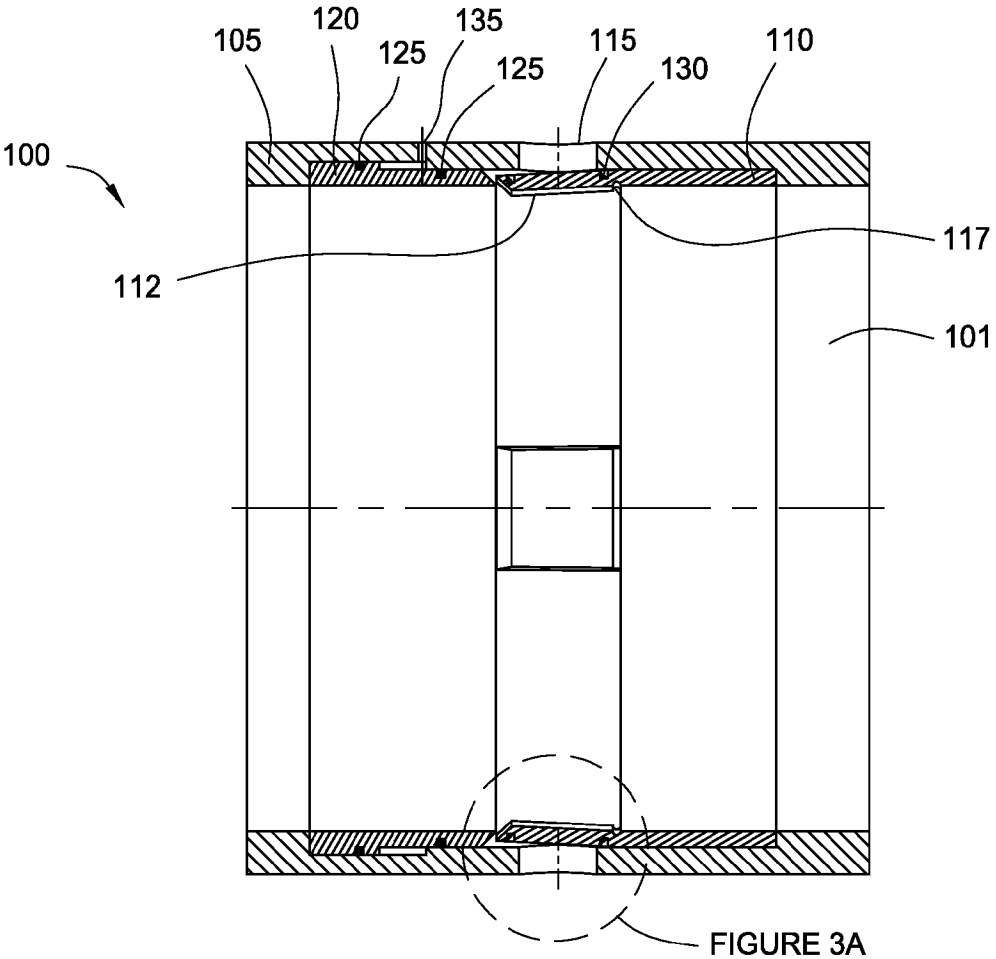
FIG. 3 is a cross sectional view of the valve assembly of FIG. 2 in an open position.
Figure 3A:
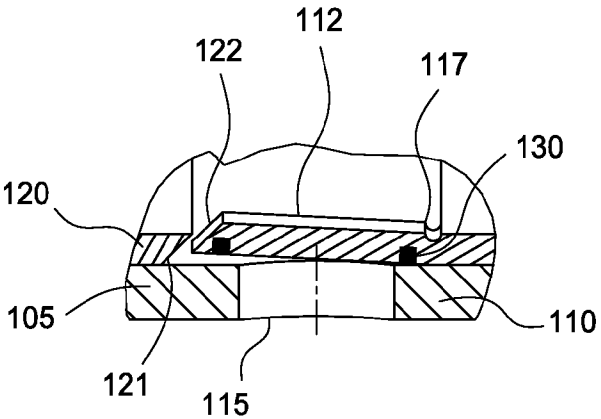
FIG. 3A is an enlarged, partial cross-sectional view of the valve assembly of FIG. 3.
Figure 5:
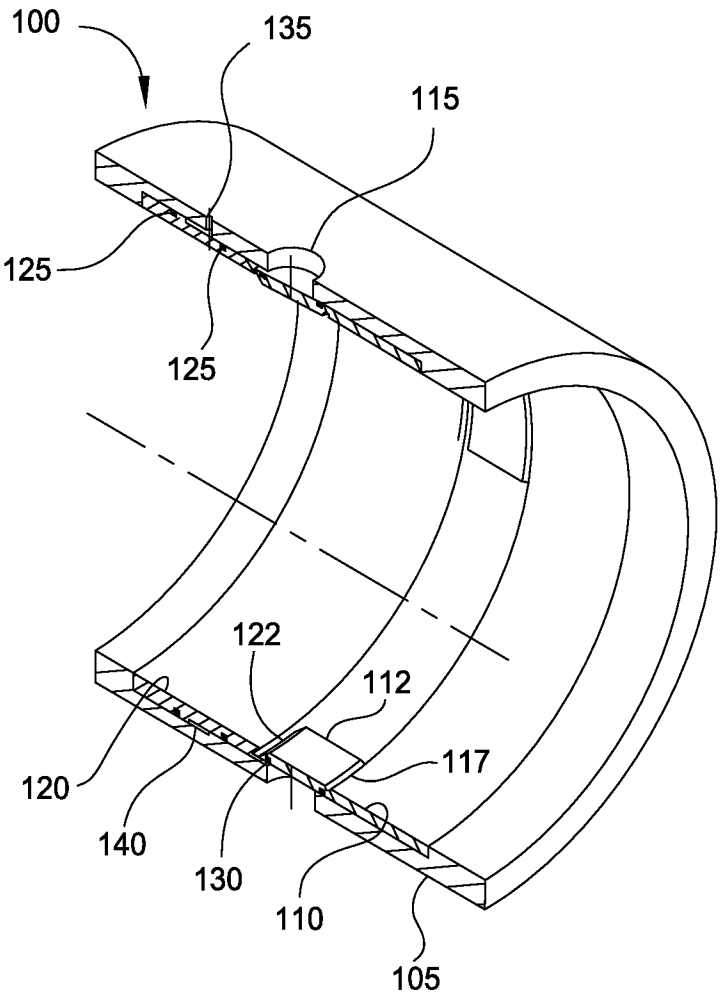
FIG. 5 is another partial cross-sectional view of the valve assembly of FIG. 3.

The retainer sleeve 120 may be moved to the disengaged position to allow the flaps 112 to open in response to a fluid pressure, as shown in FIGS. 3, 3A, and 5. Fluid from the exterior of the body 105 may be communicated through a sleeve port 135 and into a chamber 140 defined by a shoulder of the retainer sleeve 120 and a recess 142 of the body 105. Seals 125 may be positioned at the interface between the retainer sleeve 120 and the body 105 to seal the chamber 140. A pressure increase communicated to the chamber 140 that overcomes the optional biasing member and the interior pressure of the bore 101 causes the retainer sleeve 120 to move away from the flaps 112, thereby allowing the flaps 112 to open. When the pressure decreases, the retainer sleeve 120 is moved back into engagement with the flaps 112 by the internal pressure of the bore 101 and the optional biasing member. In the event the flap 112 is not completely closed; for example, does not completely flex back to the original position, the taper edge 121 of the retainer sleeve 120 can engage the flap 112 and return the flap 112 into contact with the body 105. In one embodiment, the retainer sleeve 120 may be configured to move at same or different predetermined pressure differentials. In another embodiment, the retainer sleeve 120 and the flaps 112 may open at the same or different pressure differentials. In yet another embodiment, the retainer sleeves 120 on the valve assembly 100 may open at the same pressure differential, while the flaps 112 open at different pressure differentials. In another embodiment, the retainer sleeve 120 may be optionally secured to the body 105 using a shearable member such as a shearable pin. The shearable pin may prevent accidental activation of the retainer sleeve during drilling or tool running into or out of the wellbore. In this respect, the initial activation of the valve assembly 100 may require a hydraulic force that is higher than the combination of the biasing force, the pressure in the annulus B, and the shear force of the shearable member. Subsequent activations only require overcoming the biasing force plus the pressure in annulus B. In another embodiment, the shearable pin may be mechanically sheared using a shifting tool.

Referring back to FIG. 1, the valve assembly 100 may be operable to control fluid communication between the annulus A and the annulus B. The annulus A surrounds the valve assembly 100, and the annulus B is in fluid communication with the bore 101 of the valve assembly 100. FIGS. 2, 2A, and 4 show the valve assembly 100 in the closed position. During operation, pressure in the annulus A may act on the chamber 140 of the retainer sleeve 120 via the sleeve port 140 to move the retainer sleeve 120 against any pressure force in the annulus B acting on the retainer sleeve 120, and, if used, the force of the biasing member. When the retainer sleeve 120 disengages from the flaps 112, the flaps 112 are allowed to open. Pressure in annulus A communicated through the relief ports 115 causes the flaps 112 to flex inward, thereby exposing the relief ports 115 for fluid communication. FIGS. 3, 3A, and 5 show the valve assembly 100 in the open position. Pressurized fluid may flow from the annulus A to the annulus B through the relief ports 115 of the valve assembly 100. The valve assembly 100 is thus operable to relieve and prevent any pressure differential that may cause burst of casing 10 or collapse of the casing 20.

When the pressure in the annulus A decreases to a predetermined amount, the flaps 112 flex back to close the relief port 115. Also, pressure in annulus B and the biasing member may move the retainer sleeve 120 back into engagement with the flaps 112. In this manner, the valve assembly 100 is operable as a one-way valve in that it will permit fluid flow into the bore 101 of the valve assembly 100 but will prevent fluid flow out of the bore 101 via the relief port 115. The valve assembly 100 is automatically resettable downhole and may be operated multiple times in response to any pressure fluctuations within the wellbore 5. As stated above, any of the casings 10, 20, 30 and/or the tubular members 40, 45 may each be provided with one or more valve assemblies 100 to allow fluid flow from a surrounding casing or tubular member to an inner casing or tubular member, while preventing fluid flow in the opposite direction.

In one embodiment, a casing or tubular member may be provided with multiple valve assemblies 100 that are spaced apart along the length of the casing or tubular member. The valve assemblies 100 may be operable to open and/or close at different pre-determined pressure setting.

While the foregoing is directed to embodiments of the invention, other and further embodiments of the invention may be devised without departing from the basic scope thereof, and the scope thereof is determined by the claims that follow.

The invention claimed is:

1. A valve assembly, comprising:

a tubular body having a port for fluid communication;

a valve ring disposed within the tubular body, the valve ring having a closure member for closing the port, wherein the closure member is configured to flex from a closed position to an open position in response to a pressure differential; and a retainer sleeve movable from an engaged position for maintaining the closure member in the closed position to a disengaged position to allow the closure member to open.

2. The valve assembly of claim 1, further comprising a biasing member for biasing the retainer sleeve in the engaged position.

3. The valve assembly of claim 1, wherein the retainer sleeve includes a taper edge for engaging a corresponding taper edge of the closure member.

4. The valve assembly of claim 1, wherein the closure member flexes with respect to a groove in the valve ring.

5. The valve assembly of claim 1, further comprising a seal disposed on the closure member.

6. The valve assembly of claim 1, wherein the closure member comprises a flap.

7. The valve assembly of claim 6, wherein the flap extends from an axial end of the valve ring.

8. The valve assembly of claim 6, wherein at least one flap extends from a first axial end and at least one flap extends from a second axial end.

9. The valve assembly of claim 6, wherein the flap flexes with respect to a groove in the valve ring.

10. The valve assembly of claim 9, wherein the pressure differential to open the flap is different from a pressure differential to move the retainer sleeve.

11. The valve assembly of claim 10, wherein the flap extends from an axial end of the valve ring.

12. The valve assembly of claim 1, wherein a higher pressure differential is required to open the closure member than to close the closure member.

13. The valve assembly of claim 1, wherein the valve ring is disposed in a recess in an interior wall of the tubular body.

14. The valve assembly of claim 1, wherein the valve ring includes a plurality of closure members.

15. The valve assembly of claim 1, wherein the closure member is positioned between two ends of the valve ring.

16. The valve assembly of claim 1, wherein the retainer sleeve moves from the engaged position to the disengaged position in response to a second pressure differential.

17. The valve assembly of claim 16, wherein the pressure differential to open the closure member is different from the second pressure differential.

18. The valve assembly of claim 1, further comprising a shearable member for securing the retainer sleeve to the tubular body.

19. A method of controlling fluid communication between an exterior of a wellbore tubular and an interior of the wellbore tubular, comprising:

installing a valve assembly on the wellbore tubular, wherein the valve assembly includes a closure member covering a port in the wellbore tubular;

retaining the closure member in a closed position using a retainer sleeve; and disengaging the retainer sleeve from the closure member and then flexing the closure member inwardly to open the port in response to a predetermined pressure differential.

20. The method of claim 19, wherein the retainer sleeve is hydraulically actuated.

21. The method of claim 20, wherein the retainer sleeve is actuated at a pressure differential that is different than the predetermined pressure differential to open the closure member.

22. A tubular assembly for lining a wellbore, comprising:

a tubular for lining a portion of the wellbore; and a valve assembly for controlling fluid flow between an exterior of the tubular and an interior of the tubular, wherein the valve assembly includes:

a body coupled to the tubular and having a port for fluid communication;

a valve ring disposed within the body, the valve ring having a closure member for closing the port, wherein the closure member is configured to flex from a closed position to an open position in response to a pressure differential; and a retainer sleeve movable from an engaged position for maintaining the closure member in the closed position to a disengaged position to allow the closure member to open.

23. The tubular assembly of claim 22, further comprising a second valve assembly having:

a body coupled to the tubular and having a port for fluid communication;

a valve ring disposed within the body, the valve ring having a closure member for closing the port, wherein the closure member is configured to flex from a closed position to an open position in response to a pressure differential; and a retainer sleeve movable from an engaged position for maintaining the closure member in the closed position to a disengaged position to allow the closure member to open.

24. The tubular assembly of claim 23, wherein the closure member of the first valve assembly opens at a different pressure differential than the closure member of the second valve assembly.

* * * * *